US005264818A

United States Patent [19]

Truchet et al.

[11] Patent Number: 5,264,818

[45] Date of Patent: Nov. 23, 1993

[54] DEVICE FOR SIGNALING THE TRIGGERING OF A CIRCUIT BREAKER

[75] Inventors: Bernard Truchet, Besayes; Jean-Marie Vergnes, Valence, both of France

[73] Assignee: Sextant Avionique, Cedex, France

[21] Appl. No.: 918,099

[22] Filed: Jul. 24, 1992

[30] Foreign Application Priority Data

Jul. 25, 1991 [FR] France ..... 91 09684

[51] Int. Cl.[5] ..... H01H 71/04

[52] U.S. Cl. ..... 337/79; 337/66; 335/13

[58] Field of Search ..... 337/79, 66, 69, 70, 337/74; 335/17, 13

[56] References Cited

U.S. PATENT DOCUMENTS 3,214,537 10/1965 Krieger .
3,697,915 10/1972 Brassard ..... 337/74
4,024,487 5/1977 Krasser et al. .
4,110,719 8/1978 Kirkup .
4,612,528 9/1986 Peter ..... 337/79

FOREIGN PATENT DOCUMENTS 2108806 5/1972 France .
247547 3/1947 Switzerland .

*Primary Examiner*—Harold Broome
*Attorney, Agent, or Firm*—Lowe, Price, LeBlanc & Becker

[57] ABSTRACT

A circuit breaker comprises a lock (12) having a high position when the circuit breaker is triggered and a low position when the circuit breaker is set. The lock in the low position is held by a locking lever (10) against which the lock abuts. The lever cooperates with a device for detecting a current surge which, during a surge, disengages the lever so that the lock no longer abuts against the lever and is released in order to go back to its high position. The locking lever is movable between a high position and a low position, urged to its low position when the lock is set to low position, and associated with upward biasing means active (50) when the lock no longer abuts against the lever.

7 Claims, 3 Drawing Sheets

DEVICE FOR SIGNALING THE TRIGGERING OF A CIRCUIT BREAKER

BACKGROUND OF THE INVENTION

The present invention relates to circuit breakers and more particularly to a safety device and/or to a device for signaling the triggered state of a circuit breaker.

In order to detect current surges, circuit breakers comprise an element, such as a bimetal blade, subject to deformation when it is heated by the passage of a current. Generally, the triggering device includes a main bimetal blade coupled by a connecting rod to a compensation bimetal blade associated with triggering means. The main bimetal blades of circuit breakers generally comprise an end fixed to the circuit breaker housing and a free end which is adjusted to a predetermined rest position determining the triggering surge value of the circuit breaker. This predetermined position is generally obtained by adjusting the inclination of the bimetal blade by a perpendicular screw abutting against the bimetal blade and screwed in the housing of the circuit breaker. The fixed end of the bimetal blade is conventionally directly welded to an input connector fixed to the circuit breaker housing.

A drawback of this configuration is that constraints external to the circuit breaker may deform the input connector and consequently alter the bimetal blade position. These external constraints may, for example, occur when a screw is tightened to fix a cable to the connector.

Some circuit breakers are provided with a signaling device for indicating to an operator that the circuit breaker is at the triggered state. Generally, circuit breakers comprise a fixed contact and a movable contact associated with a control mechanism for applying the movable contact onto the fixed contact when the circuit breaker is set and for causing the reverse movement when the circuit breaker is triggered. Signaling devices are conventionally controlled by the triggering movement of the control mechanism. However, contacts may remain sticked together due to a surge. In order to be sure that the circuit is interrupted even in that case, an element in the current path, for example a bimetal blade, is provided to act as a fuse. But, since the contacts have not been separated, the control mechanism remains blocked and does not activate the signaling device. Hence, an operator cannot know whether the circuit has been interrupted.

Multipolar circuit breakers for multiple phased currents generally include a pair of contacts per phase. These contact pairs cooperate with a single control mechanism so that all the phases are interrupted when a surge occurs in one of the phases. If, during a surge, one of the contact pairs remains in contact, as in the above example, the control mechanism remains blocked and the contact pairs associated to the other phases also remain in contact, which is undesirable.

An object of the invention is to provide a device for signaling the triggered state of the circuit breaker which is still operational even when contacts remain in contact.

Another object of the invention is to provide a safety device incorporated in a multipolar circuit breaker which separates the other contacts, in case one of the pairs of contacts remains in contact following a current surge.

These objects are achieved with a circuit breaker comprising a lock having a high position when the circuit breaker is triggered and a low position when the circuit breaker is set, the lock in the low position being held by a locking lever against which the lock abuts, the lever cooperating with a device for detecting a current surge which, during a surge, disengages the lever so that the lock no longer abuts against the lever and is released in order to go back to its high position. The locking lever is movable between a high position and a low position. The lever is urged to its low position when the lock is set to low position and is associated with upward biasing means active when the lock no longer abuts against the lever.

According to an embodiment of the invention, the circuit breaker comprises a contact for signaling the triggering of the circuit breaker, the contact being associated with closing means active when the locking lever is at its high position.

According to an embodiment of the invention, the locking lever abuts at its high position against an end of a lever, the other end of which closes the contact.

According to an embodiment of the invention, the circuit breaker comprises a plurality of similar triggering mechanisms and means for simultaneously triggering these mechanisms when the locking lever is at its high position.

According to an embodiment of the invention, each locking lever at its high position abuts against one end of a second lever fixed to an axle on which similar second levers are fixed, the other ends of these second levers disengaging the locking levers from the other mechanisms of the circuit breaker in order to release the associated locks.

According to an embodiment of the invention, the surge detecting device comprises a main bimetal blade, substantially vertical, the base of which is fixed to the circuit breaker housing, a compensation bimetal blade, substantially vertical, the base of which is articulated to the housing and a connecting rod sliding between the upper ends of the bimetal blades, the compensation bimetal blade being disposed so as to disengage the locking lever when the main bimetal blade is sufficiently bent.

According to an embodiment of the invention, the upward biasing means comprises a spring disposed in slots opening at the bottom of the locking lever, the spring pressing between a part fixed to the housing and the interior of the slots.

BRIEF DESCRIPTION OF THE DRAWINGS

The foregoing and other objects, features and advantages of the invention will be apparent from the following detailed description of preferred embodiments as illustrated in the accompanying figures wherein.

DETAILED DESCRIPTION OF THE INVENTION

Figure 1B:
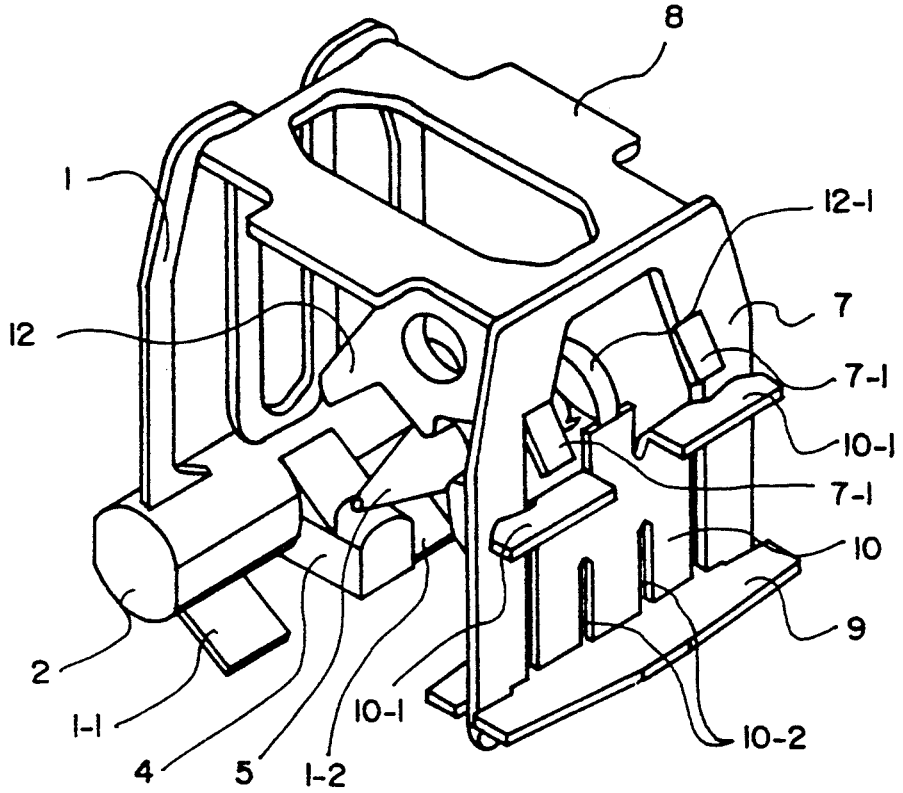
FIG. 1B is a perspective view of the main elements of a surge detection device of a circuit breaker according to the invention incorporating the adjusting device of FIG. 1A.
Figure 1A:
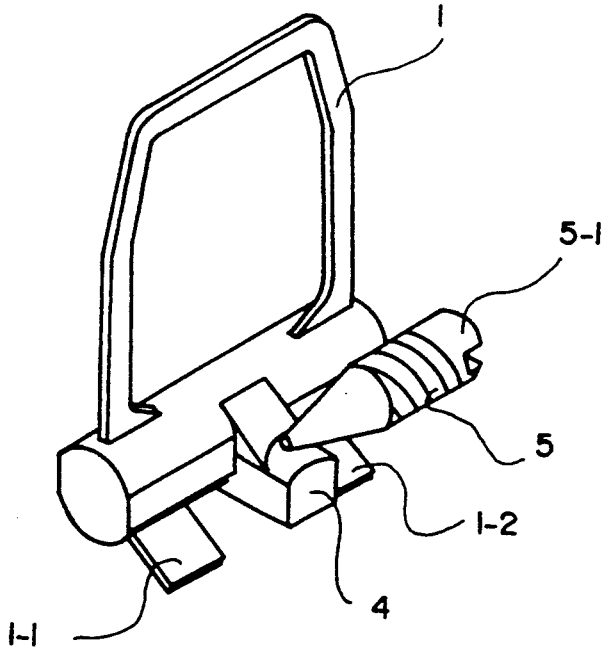
FIG. 1A is a perspective view of an embodiment of a device according to the invention for adjusting the surge value triggering a circuit breaker.
Figure 2B:
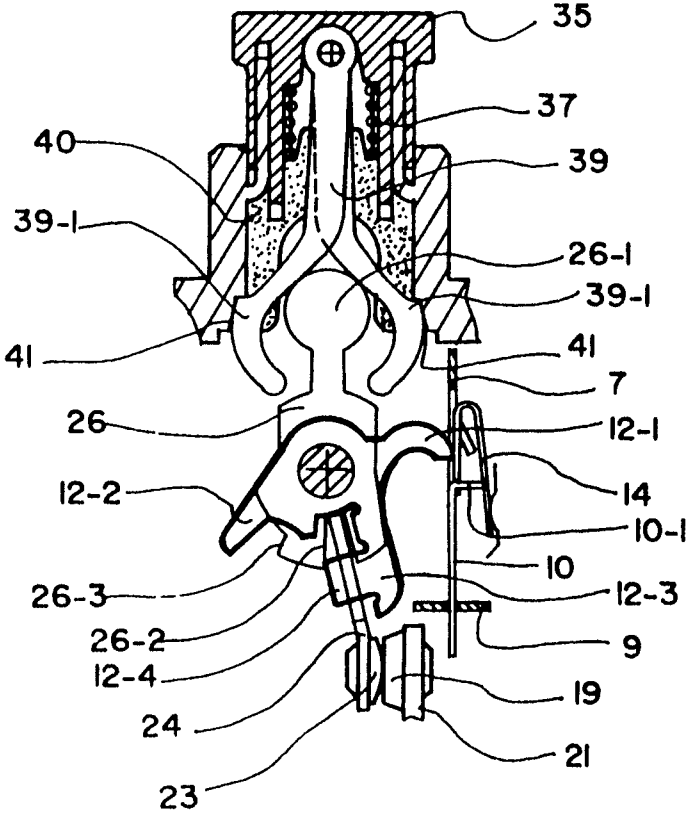
FIG. 2B is a partial view of the circuit breaker of FIG. 2A in a set position.
Figure 2A:
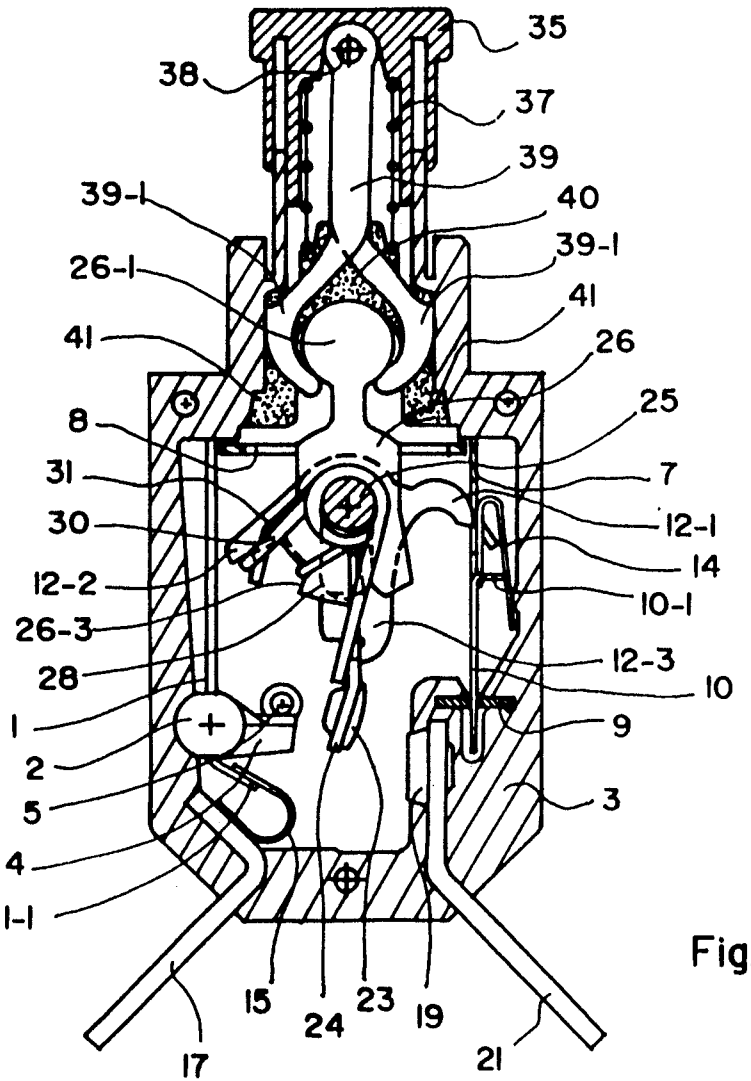
FIG. 2A is a simplified cross-section of a circuit breaker according to the invention in a triggered position.

The elements of FIGS. 1A and 1B are also shown in FIG. 2A according to a different view angle and these three figures will be referred to simultaneously to have a better overview of the shapes and arrangement of the elements.

In FIGS. 1A–2A is shown an embodiment of a device for adjusting the position of a main bimetal blade 1. This device is shown alone in FIG. 1A and cooperating with the elements of the circuit breaker in FIGS. 1B and 2A.

The bimetal blade is for example, as shown in FIG. 1A, shaped like a reversed "U" or, as shown in FIG. 1B, like a meander, which is conventional for small surge value circuit breakers. The lower portion of bimetal blade 1 is embedded in an isolating axle 2 (preferably made of ceramics) parallel to the bimetal blade plane. The front and rear ends of axle 2 are articulated in the front and rear walls (not shown) of the housing of the circuit breaker, referenced 3 in FIG. 2A. Axle 2 comprises a perpendicular lever 4 extending to the right in the figure. The tapered end of a screw 5 parallel to axle 2 abuts against the upper part of lever 4. Screw 5 is screwed into a female thread of the rear wall of housing 3 and its head 5-1 is apparent outside the housing. Thus, when screwing or unscrewing screw 5, the inclination of bimetal blade 1 is adjusted to the left.

Preferably, a portion of axle 2 is apparent outside the housing. This allows, once the inclination of the bimetal blade has been adjusted, blocking screw 5 and axle 2 by depositing a drop of a resin, that can polymerize, onto the apparent portions of the screw and axle.

In FIG. 1B, a compensation bimetal blade 7 substantially parallel to the main bimetal blade 1 is disposed at the right of the latter. Between the upper ends of bimetal blades 1 and 7, a connecting rod 8 is disposed which can slide to the left or to the right along grooves provided in the front and rear walls of housing 3. Bimetal blade 7 is shaped like a reversed U, the legs of which are inserted with clearance by their ends in grooves provided in a support 9 fixed to housing 3. This mounting of the legs of bimetal blade 7 constitutes an articulation giving bimetal blade 7 a certain freedom of inclination. Between the legs of bimetal blade 7 a vertical locking lever 10 is disposed, the base of which is similarly inserted in a groove of support 9. Locking lever 10 includes, at approximately the middle of bimetal blade 7, two upper portions 10-1 bent to the right and extending towards the front and the back, respectively. Portions 10-1 form stoppers against which bimetal blade 7 abuts when it is tilted to the right.

A lock 12 comprises a beak 12-1 abutting against the upper portion of lever 10. See FIGS. 3A, 3B, 4A and 4B. This position of lock 12 corresponds to the set position of the circuit breaker. As will be seen later on, in this position, beak 12-1 tends to go down for triggering the circuit breaker, but it is maintained by the locking lever 10. A hairpin-shaped spring 14 (shown in FIG. 2A) is welded on lever 10 and abuts against the right wall of housing 3. The spring biases lever 10 towards the lock but the freedom of inclination of the lever, given by the way the lever is mounted in support 9, is such that the stoppers 10-1 do not abut, at rest, against bimetal blade 7.

The device operates as follows. When the main bimetal blade 1 is traversed by a current, the bimetal blade is heated and bends to the right. If the temperature rise of bimetal blade 1 is sufficient, that is, if the current value and duration of the current in the bimetal blade are sufficient, bimetal blade 1 is bent while cancelling the longitudinal clearance of connecting rod 8 between the upper ends of the bimetal blades. From this position, if bimetal blade 1 continues to bend, bimetal blade 7 abuts against stoppers 10 1 while urging the locking lever 10 to the right against the force of spring 14. Then, lever 10 releases beak 12-1 which plunges downwards and triggers the circuit breaker.

Thus, the necessary heating of bimetal blade 1 for triggering the circuit breaker depends upon the above clearance of connecting rod 8. This clearance therefore determines the value of the surge current which triggers the circuit breaker. The value of this clearance corresponding to a nominal surge current is factory set, as above indicated, by adjusting the inclination of the main bimetal blade 1 by means of the tapered-end screw 5.

Further, the role of the compensation bimetal blade 7 is to bend to the same extent as the main bimetal blade 1 when the temperature in the circuit breaker housing increases so that the adjustment clearance remains constant. Considering that bimetal blades are bent in an arc of a circle, the position of bimetal blade 7 at the level of stoppers 10-1 is only very slightly altered.

FIG. 2A also shows a flexible metal ribbon 15 connecting a terminal 1-1 of the bimetal blade, extending below axle 2, to a connector 17 extending downward and to the left outside the housing of circuit breaker 3. The flexibility of ribbon 15 prevents any deformation of connector 17 from being transmitted to the main bimetal blade 1. By adapting the section of ribbon 15, the latter can serve as a fuse which would melt in case of a surge when the circuit breaker contacts are not separated from each other. Thus, the complexity in manufacturing a main bimetal blade 1 which should furthermore act as a fuse is avoided.

Referring to FIGS. 2A and 2B, an embodiment of a complete circuit breaker will now be described in more detail.

A vertical fixed contact 19 is fixed at the lower right portion of the circuit breaker to a connector 21 extending downward and to the right outside housing 3 of the circuit breaker. A movable contact 23 is fixed to a contact-holder 24 extending upwards. An output terminal 1-2 (shown in FIG. 1) of bimetal blade 1 is in this example connected to a fixed contact (not shown) positioned behind the fixed contact 19 and movable contact 23 is in fact a double contact connecting the two fixed contacts to close the circuit. The output terminal 1-2 of bimetal blade 1 could also be connected to the movable contact 23 by a conductive braid.

FIG. 2A corresponds to the triggered position of the circuit breaker. The movable contact 23 is shifted to the left and upwards with respect to the fixed contact 19. When the circuit breaker is activated to attain the set position of FIG. 2B, the control mechanism, described hereunder, first causes contact 23 to go down and then applies the latter onto contact 19 by a rotating movement.

Lock 12 is articulated by an axle 25 on a plunger 26. A vertical oblong hole 28 (drawn in dotted lines) formed in the front and rear walls of housing 3 and in which axle 25 slides, gives the plunger 26 a freedom of movement between a high position (FIG. 2A) and a low position (FIG. 2B). The shapes of lock 12 and plunger 26 can be more clearly seen in FIG. 2B in which some elements are not shown, the lock being drawn in bold.

In addition to beak 12-1 extending to the right, the lock comprises an extension 12-2 to the left and downwards and an extension 12-3 downwards. The plunger 26 comprises at its top a cylindrical portion 26-1 coupled to the rest of the plunger by a thin portion. The cylindrical portion is of horizontal axis, parallel to the bimetal blades. The lower portion of plunger 26 comprises a slot 26-2, a wall of which is vertical and the other slightly tilted to the right. In slot 26-2 is accommodated the upper end of the contact-holder 24. Thus, the contact-holder 24 has a certain freedom of rotation with respect to the point where the end of the contact-holder abuts in the slot. The contact-holder is held in this slot by a protruding part 12-4 extending to the left from extension 12-3 and sliding in a groove of contact-holder 24. The bottom of plunger 26 comprises a shoulder 26-3 disposed on the right and facing extension 12-2 of lock 12.

In FIG. 2A, axle 25 comprises two spiral springs. A spiral spring 30 abuts between extension 12-2 and contact-holder 24 and tends to urge the contact-holder against extension 12-3. Another thinner spiral spring 31 abuts between extension 12-2 and shoulder 26-3 tending to rotate lock 12 clockwise about its axle 25. In the position of FIG. 2A, spring 30 maintains contact-holder 24 in abutment against extension 12-3 of the lock. Lock 12, contact-holder 24 and spring 30 form in this position a single part capable of rotating about axle 25. This single part is maintained in abutment against the left surface of slot 26-2 by spring 31.

In FIG. 2B, plunger 26 is represented in low position where contacts 23 and 19 are closed. As plunger 26 goes down, beak 12-1 is urged against the upper part of locking lever 10 and the single part (12, 24, 30) rotates counter-clockwise, compressing spring 31 between extension 12-2 and shoulder 26-3. This single part rotates until contact 23 encounters contact 19. From this position, lock 12, contact-holder 24 and spring 30 become independent again. Contact 23 and its corresponding contact holder 24 remain stationary and lock 12 continues rotating while compressing spring 30 which then strongly urges contact 23 against contact 19.

The positions shown in FIGS. 2A and 2B are stable positions obtained with the elements described hereunder. At the upper part of the circuit breaker is disposed a control button 35 comprising internal and external vertical cylindrical portions which guide the button on both sides of an upper cylindrical portion of housing 3. A spring 37 abutting between button 35 and a portion of housing 3 tends to raise the button. The upper portion of button 35 comprises an axle 38 on which is articulated a pair of grips 39 imprisoning the cylindrical portion 26-1 of plunger 26. Grips 39 slide vertically through the upper portion of housing 3 in a slot 40 parallel to the plane of the grips. The visible rear wall of slot 40 is shown by a dotted area.

At the position shown in FIG. 2A, grips 39 are held closed by the left and right walls of slot 40. The cylindrical portion 26-1 is held at its bottom by the ends of the grips and pulled up by spring 37. This mechanism is at its upper position when axle 25 abuts against the upper part of the oblong hole 28 or when the upper portion of the cylindrical part 26-1 abuts against the lower lips of slot 40, as shown in FIG. 2A.

At the position shown in FIG. 2B, when button 35 has been pressed, the pressure of beak 12-1 on the upper portion of lever 10, provided by the spiral spring 31, tends to raise plunger 26 and to urge the cylindrical portion 26-1 inside the grips 39. Grips 39 therefore tend to separate from each other and when the mechanism arrives at the position shown in FIG. 2B, external lands 39-1 of the grips are accommodated in widenings 41 of slot 40. The pressure of the cylindrical portion 26-1 inside the grips, urging the grips to open, overcomes the resistance of spring 37 tending to close the grips and the mechanism is held locked in this position.

The occurrence of a surge current causes lever 10 to be tilted to the right, beak 12-1 is then released and the latter no longer urges the cylindrical part 26-1 inside the grips. Thus, grips 39 are closed again by the force of spring 37, go up while pulling the plunger by the cylindrical portion 26-1 and return to the position shown in FIG. 2A. In the meanwhile, lock 12 rotates clockwise under the influence of springs 30 and 31 while separating the contacts and goes up simultaneously.

Additionally, in order to manually trigger the circuit breaker, an operator will overcome the force maintaining grips 39 opened by pulling button 35.

Figure 3A:
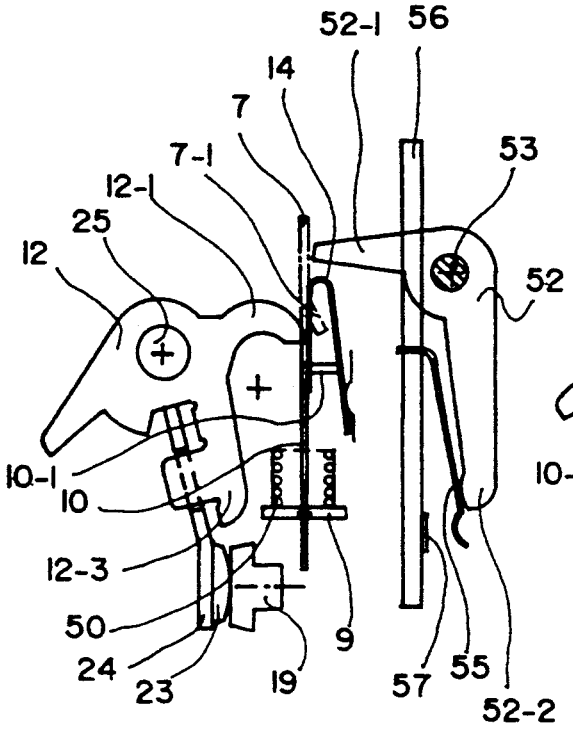
FIGS. 3A and 3B are partial views showing two positions of an embodiment of a signaling device.
Figure 3B:
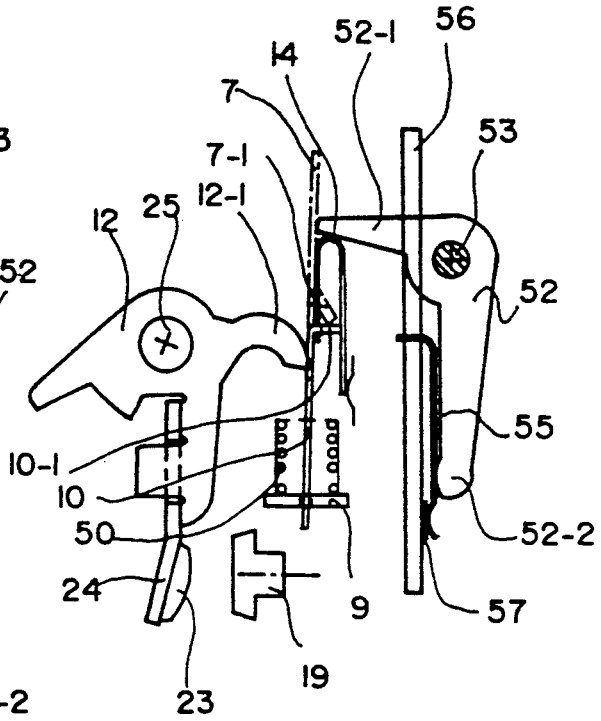

FIGS. 3A and 3B show two positions of an embodiment of a triggered state signaling device adapted to the above circuit breaker. These figures show like elements as those of the previous figures, designated by like references. A spring 50 abutting against support 9 tends to raise the locking lever 10 which is mounted so as to slide at its base through support 9. Spring 50 is disposed in slots 10 2 (shown in FIG. 1) of lever 10, opening towards support 9. Extensions 7-1 towards the bottom and the right of bimetal blade 7 prevent the lever from raising too high and sliding out of its support 9. These extensions 7-1 are more visible in FIG. 1.

The position shown in FIG. 3A corresponds to the set position of FIG. 2A where beak 12-1 is pressed against the upper portion of locking lever 10. The stiffness of spring 50 is selected so that the pressure of beak 12-1, provided by the above springs 30 and 31, fully compresses spring 50.

FIG. 3B shows a position at a moment immediately following the release of beak 12-1 after a surge has caused locking lever 10 to shift to the right and has released beak 12-1. Then, spring 50 is released which raises locking lever 10. Lever 10 attains a final high position when a portion of this lever brings a mechanism to abutment, such as a signaling mechanism comprising elements not yet described of FIGS. 3A and 3B. The high position of lever 10 is such that the portion of lever 10 on which beak 12-1 abuts is below beak 12-1 when lock 12 is at its high position.

If contacts 23 and 19 remain in contact, i.e., stuck to each other, following a surge, lever 10 is nevertheless separated from beak 12-1 and is raised by the force of spring 50. The movement of the lever can be used to activate various alarm or safety mechanisms. In conventional circuit breakers in which lever 10 is fixed, these mechanisms are unavoidably activated by the movement of the movable contact and, hence, do not operate if the contacts are stuck together.

FIGS. 3A and 3B show an application in which lever 10 activates a triggered state signaling mechanism. This mechanism comprises a lever 52 articulated about an axle 53 fixed to the housing of the circuit breaker. Lever 52 comprises an extension 52-1 to the left above lever 10 and a downward extension 52-2. A conductive elastic blade 55 is mounted on a vertical isolating plate 56 fixed to the circuit breaker housing and extends downwards at the left of extension 52-2 of lever 52. Plate 56 comprises a contact 57 facing the bottom of blade 55. In FIG. 3B, when the locking lever 10 goes up, an element fixed to lever 10, for example the upper portion of the above mentioned spring 14, abuts against extension 52 1 of lever 52. Lever 52 rotates and its extension 52-2 urges the lower end of blade 55 against contact 57. The closing of this contact can, for example, trigger a ringing signal or light up a signal lamp.

Figure 4A:
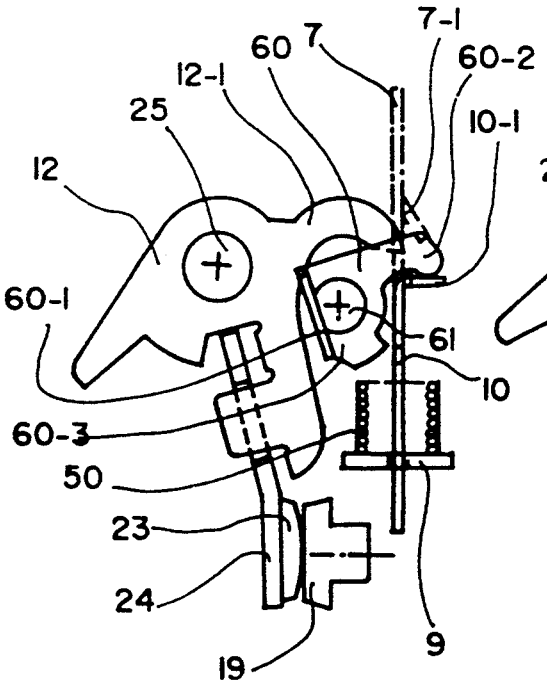
FIGS. 4A and 4B are partial views showing two positions of an embodiment of a device for separating non-sticked contacts in a multipolar circuit breaker.
Figure 4B:
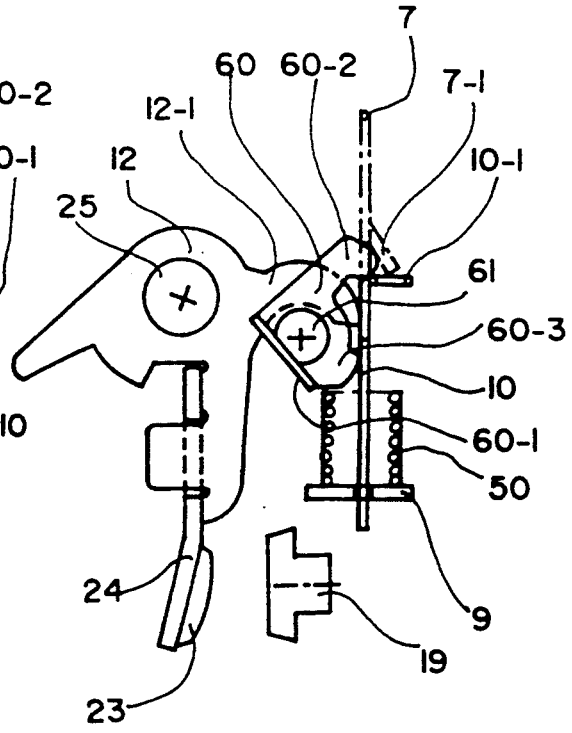

FIGS. 4A and 4B illustrate an application of the mechanism of FIGS. 3A and 3B to a safety device for simultaneously separating the contacts of a multipolar circuit breaker. A multipolar circuit breaker comprises several pairs of contacts, each associated to an isolated electric circuit. FIGS. 4A and 4B show positions corresponding to FIGS. 3A and 3B, where like elements are designated by like references. The elements represented are those associated with a single pair of contacts. The locks 12 associated respectively with each of the contact pairs are articulated about a same axle 25 which is activated by a single control mechanism (plunger 26, button 35, grips 39).

In FIG. 4A, spring 50 is compressed by the pressure of beak 12-1 and locking lever 10 is at its low position. The device for simultaneously separating the contacts comprises a lever 60 fixed to an axle 61 articulated with respect to the circuit breaker housing and disposed at the left of lever 10. Lever 60 is fixed in rotation to axle 61, for example as shown in the figure, by a folded portion 60-1 on a flat of axle 61. Lever 60 comprises an extension 60-2 above stopper 10-1 of locking lever 10 and a beak 60-3 near locking lever 10 below stopper 10-1.

In FIG. 4B, beak 12-1 of a specific pair of contacts has just been released due to a surge. The corresponding locking lever 10 is raised and stopper 10-1 pushes extension 60-2 of the corresponding lever 60. Levers 60 associated with the other contact pairs are similarly moved, their beaks 60-2 abut against the associated locking levers 10, push the latter to the right and release the associated beaks 12-1. Then, the locks 12 associated to these contact pairs rotate clockwise, causing the separation of the associated contacts.

Following the occurrence of a surge, as in the example shown in FIGS. 3A and 3B, even if contacts 23 and 19 of a specific pair of contacts remain stuck, the corresponding locking lever 10 goes up and separates the other contact pairs.

Various alternatives and modifications of the above disclosed preferred embodiments will appear to those skilled in the art. For example, the signaling device described in relation with FIGS. 3A and 3B can be combined with the safety device of the multipolar circuit breaker of FIGS. 4A and 4B. The mechanism of FIGS. 3A–4B applies to any circuit breaker comprising a mechanism in which the lock triggers the circuit breaker by a downward movement.

We claim:

1. A circuit breaker contained within a housing, said circuit breaker comprising:

a current surge detector;

a lock having a triggered position when said circuit breaker is triggered and a set position when said circuit breaker is set;

a locking lever supported in the housing to be slidable with respect to the surge detector and in abutment to the lock, said locking lever cooperating with said surge detector so that during a surge the surge detector disengages the lock from said locking lever and allows said lock to move to the triggered position; and biasing means for providing a bias force to the locking lever such that the locking lever is slidable between a first position and a second position and is urged by the bias force to the second position when the lock is in the set position and to the first position when the lock is disengaged from the locking lever and has moved to the trigger position.

2. A circuit breaker according to claim 1, further comprising:

means for signaling the triggering of said circuit breaker;

a contact for controlling said signaling means; and closing means for activating said contact when said locking lever is in the first position.

3. A circuit breaker according to claim 2, wherein said locking lever abuts against an end of said closing means to cause another end of said closing means to activate the contact.

4. A circuit breaker according to claim 1, wherein:

said circuit breaker is a multipolar circuit breaker that controls several isolated circuits, said multipolar circuit breaker further comprising means for breaking said several isolated circuits that are activated when said locking lever is in the first position.

5. A circuit breaker according to claim 4, wherein:

said multipolar circuit further includes several sets of locking levers and locks, each set associated with a respective isolated circuit, wherein said means for breaking said several isolated circuits comprises several rotatable levers, each associated with a respective isolated circuit and communicating with a corresponding one of said several locking levers, and an axle to which said several rotatable levers are mounted to rotate therewith;

wherein any one of said several locking levers moving to the first position rotates a corresponding one of said several rotatable levers which in turn rotates said axle which causes the other rotatable levers to rotate and thereby disengages the other locking levers from the respective locks.

6. A circuit breaker according to claim 1, wherein:

said surge detector comprises a substantially vertical main bimetal blade having a main blade base which communicates with the housing, said main bimetal blade being formed to bend in response to a predetermined current flow through the circuit breaker;

a substantially vertical compensation bimetal blade base having a compensation blade which communicates with said housing; and a connecting rod sliding between respective upper ends of said main and compensation bimetal blades so as to link said main bimetal blade to said compensation bimetal blade, wherein the compensation bimetal blade disengages said locking lever from the lock when the main bimetal blade is bent to a predetermined extent in response to said predetermined current flow.

7. A circuit breaker according to claim 1, wherein:

said locking lever has a base with slots formed therein; and said biasing means comprises a spring disposed in said slots toward said base of said locking lever, said spring operating between said housing and said locking lever.

* * * * *